United States Patent [19]

Kastilahn et al.

[11] 4,135,053

[45] Jan. 16, 1979

[54] HEATING ASSEMBLY FOR A HEAT TREATING FURNACE

[75] Inventors: William W. Kastilahn; Robert R. Garrett; Vernon L. Park, all of Rockford, Ill.

[73] Assignee: Alco Standard Corporation, Valley Forge, Pa.

[21] Appl. No.: 863,805

[22] Filed: Dec. 23, 1977

[51] Int. Cl.[2] ..... H05B 3/62; F27D 11/02

[52] U.S. Cl. ..... 13/25; 338/234

[58] Field of Search ..... 13/20, 22, 25, 31; 338/234, 53, 55; 219/496

[56] References Cited

U.S. PATENT DOCUMENTS 2,320,172 5/1943 Brooke et al. ..... 13/25 UX 3,053,919 9/1962 Poole et al. ..... 13/25 X

*Primary Examiner*—R. N. Envall, Jr.

*Attorney, Agent, or Firm*—Leydig, Voit, Osann, Mayer & Holt, Ltd.

[57] ABSTRACT

Graphite heating rods are disposed within a radiant tube which contains nitrogen under pressure to prevent oxidation of the rods. The pressure in the tube is sensed and nitrogen is admitted into or exhausted from the tube depending upon whether the pressure drops below or rises above a safe range. Only as much nitrogen is introduced into the tube as is necessary to replenish that which might be lost through normal leakage and thus only a comparatively small quantity of nitrogen is required to protect the graphite rods.

5 Claims, 6 Drawing Figures

HEATING ASSEMBLY FOR A HEAT TREATING FURNACE

BACKGROUND OF THE INVENTION

This invention relates to a heating assembly for a heat treating furnace. More particularly, the invention relates to a heating assembly of the type in which an electrical resistance heating element such as a graphite rod is disposed within a radiant tube. To prevent detrimental oxidation of the heating element at high temperatures, the tube often is purged of oxygen and is filled with a protective gas such as nitrogen.

Heating elements which are protected by a non-reactive gas are disclosed in Weinheimer et al. U.S. Pat. No. 2,147,071; Kerschbaum U.S. Pat. No. 2,215,587 and Peyches U.S. Pat No. 2,253,981. With prior arrangements, however, difficulty has been encountered in maintaining the gas at a proper pressure. The pressure of the gas changes in response to temperature fluctuations and, in addition, there may be some leakage of gas from the tube. If the pressure falls below a safe value, oxygen or other reactive gases may enter the tube and damage the heating element. On the other hand, an excessively high pressure may rupture the tube or the seals thereof.

SUMMARY OF THE INVENTION

The general aim of the present invention is to provide a new and improved heating assembly in which the pressure of the protective gas within the tube is automatically maintained within a predetermined range at all times and in which wasteful flow of gas through the tube is reduced.

A more detailed object is to achieve the foregoing by sensing the pressure within the tube and by causing gas to intermittently flow into and out of the tube in response to changes in the pressure so as to maintain the pressure within a predetermined safe range. As long as the pressure remains within the safe range, no flow of gas occurs and thus the gas is not unnecessarily wasted.

A further object of the invention is to provide means for producing a warning signal if a malfunction should cause the pressure either to exceed or fall below the safe range beyond a predetermined safe period of time.

These and other objects and advantages of the invention will become more apparent from the following detailed description when taken in conjunction with the accompanying drawings.

DETAILED DESCRIPTION OF THE PREFERRED EMBODIMENT

Figure 1:
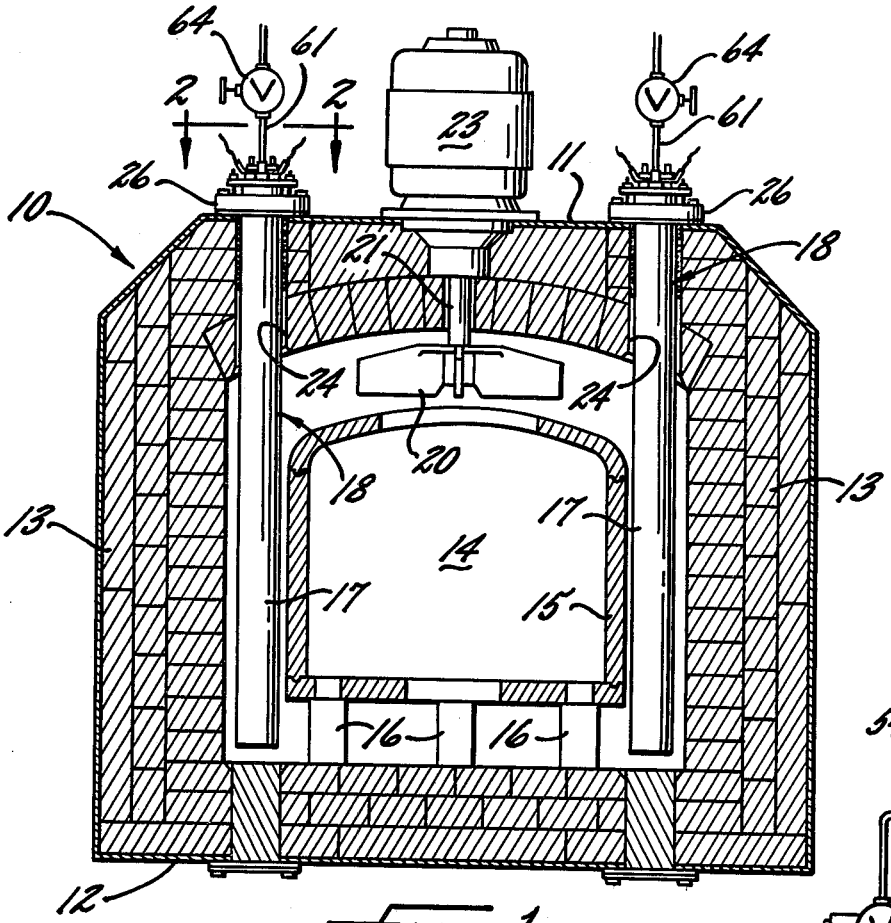
FIG. 1 is a transverse sectional view of an exemplary heat treating furnace equipped with new and improved heating assemblies incorporating the unique features of the present invention.

For purposes of illustration, the invention is shown in the drawings in conjunction with a heat treating furnace 10 whose top, bottom and side walls 11, 12 and 13 define a chamber 14 in which workpieces (not shown) are placed for treatment. In furnaces of this type, the workpieces are disposed within a box-like muffle 15 which rests on blocks 16 on the bottom of the furnace. To heat the chanber 14, radiant tubes 17 of heating assemblies 18 are disposed between the side walls of the muffle 15 and the furnace side walls 13 and extend downwardly from the top wall 11. During heating of the workpieces, the atmosphere within the chamber 14 is circulated across the heating tubes and the workpieces by a fan 20 mounted on the lower end of a vertical shaft 21 which projects downwardly through the top wall 11 and which is adapted to be driven by a motor 23. Alternatively, the workpieces may be heated in a vacuum.

Figure 2:
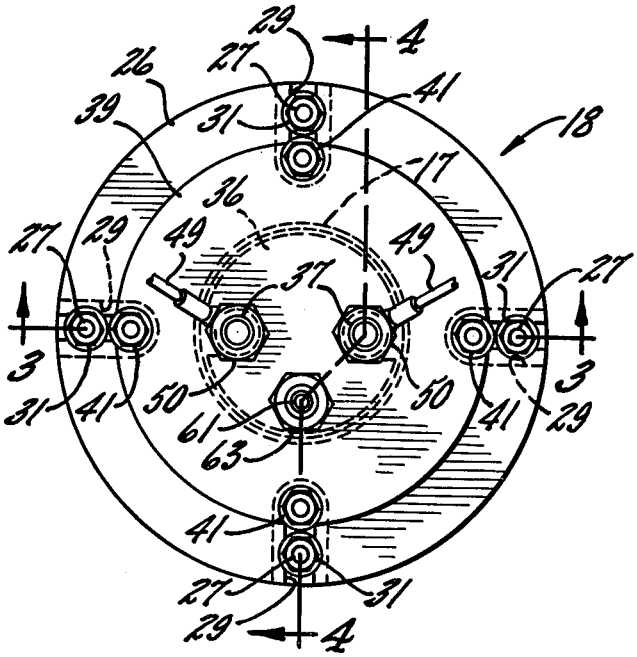
FIG. 2 is an enlarged view taken substantially along the line 2—2 of FIG. 1.
Figure 3:
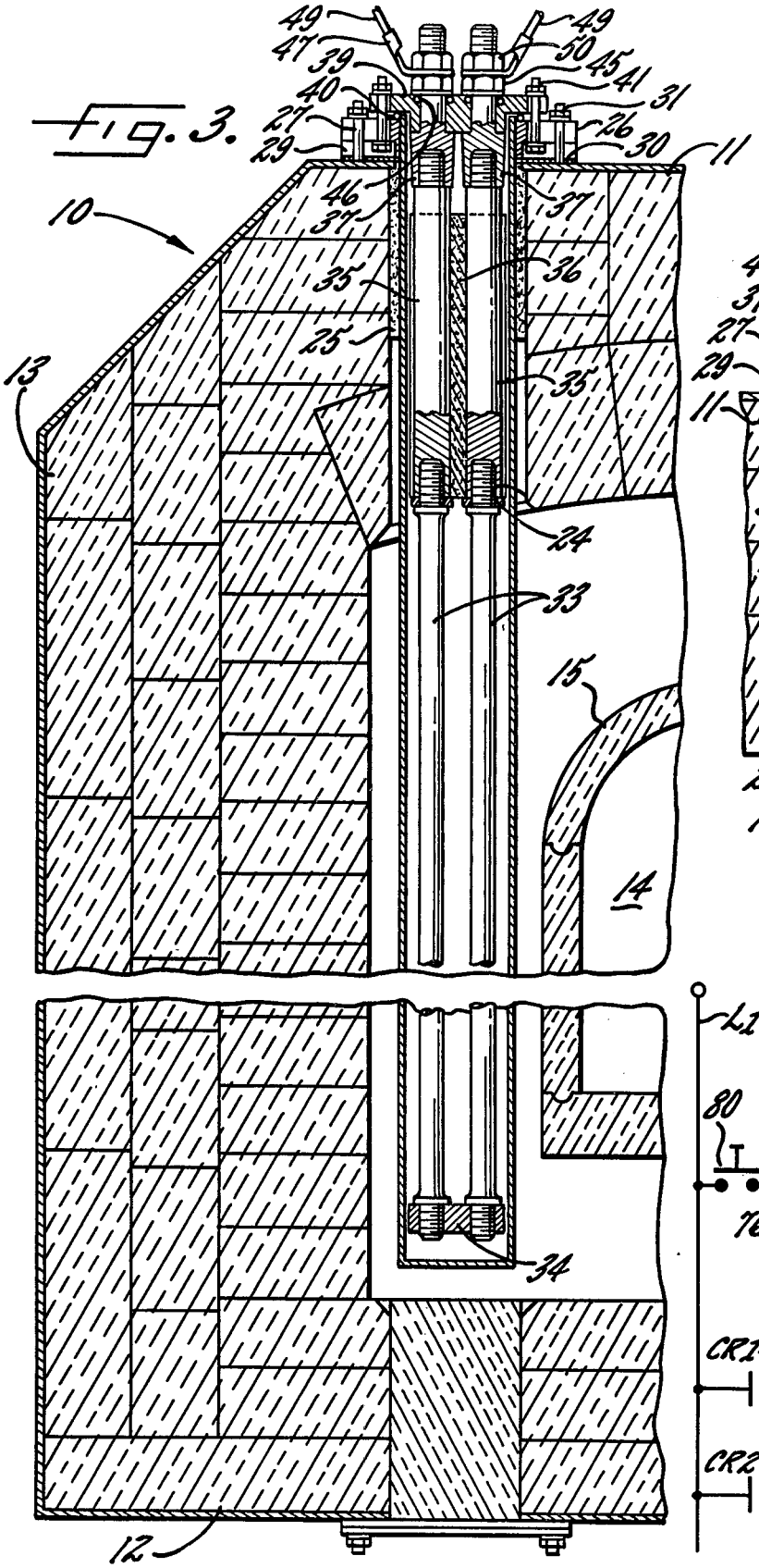
FIGS. 3 and 4 are fragmentary cross-sections taken substantially along the lines 3—3 and 4—4, respectively, of FIG. 2.
Figure 4:
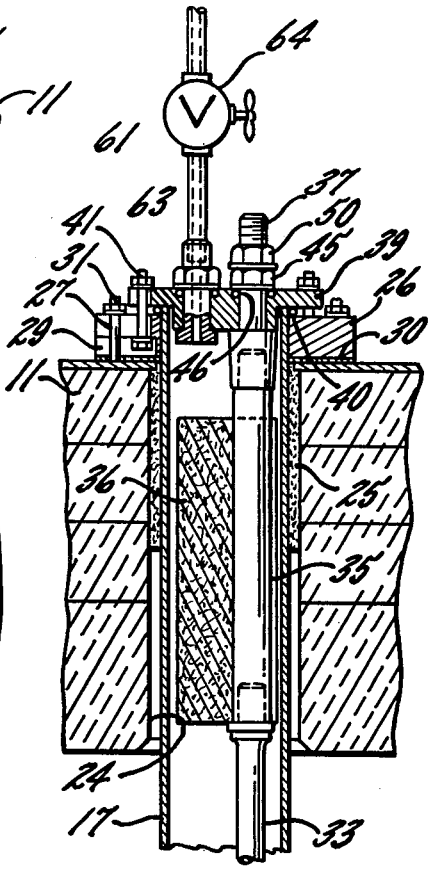

In the present instance, each heating tube 17 is made of a refractory ceramic material and is formed with an open upper end and a closed lower end. The upper end portion of each tube projects loosely through an opening 24 (FIG. 3) in the top wall 11 of the furnace 10 and is insulated with respect to the top wall by ceramic wool 25 or the like which is packed into the opening. Extending around the upper end portion of each tube is a ceramic collar 26 (FIGS. 2 and 4) which is attached to the tube by a strong, heat-resistant cement. Angularly spaced studes 27 extend upwardly from the top wall 11 of the furnace and project through radially extending slots 29 formed in the collar 26, the collar being clamped against a gasket 30 on the top wall 11 by means of nuts 31 on the upper ends of the studs.

Heating of each tube 17 is effected by a pair of electrical resistance heating elements 33 (FIG. 3) which herein are in the form of two graphite rods. The two rods 33 are disposed in side-by-side relation in the tube and are coupled at their lower end by a graphite block 34 which connects the rods electrically in series. At their upper ends, the rods 33 are threaded into two graphite connector rods 35 which are surrounded by a cylindrical, heat-resistant block 36 of electrical insulating material. The block 36 is spaced inwardly a slight distance from the inner side of the tube 17 and serves to prevent line-of-sight escape of heat from the rods 33 to the extreme upper end of the tube.

Copper terminal studs 37 (FIG. 3) are threadably connected at their lower ends to the connector rods 35 and extend upwardly through a ceramic cap 39. The latter is sealed to the upper side of the collar 26 by an O-ring 40 and is clamped securely to the collar by bolts 41 which extend upwardly through the slots 29. Each terminal stud 37 is clamped against and is sealed to the cap 39 by a nut 45 and an O-ring 46, respectively, and each receives a terminal 47 on the end of an electrical lead 49. The terminals are clamped against the nuts 45 by additional nuts 50 on the studs 37 (see FIGS. 2 and 3).

When the leads 49 are connected across a voltage source, current passes downwardly through one connector rod 35 and the connected heating rod 33, then across the connector block 34 and thence upwardly through the other heating rod 33 and the associated connector rod 35. Heat thus is produced in the heating rods and the connctor rods. The connector rods 35 are larger in diameter and shorter in length than the heating rods 33 and thus less heat is produced in the connector rods so as to provide a transitional temperature zone between the intense heat of the heating rods and the outside temperature of the cap 39. A system (not shown) for circulating water through the cap 39 may be provided for the purpose of cooling the cap and the terminal studs 37.

If the heating rods 33 are raised to a high temperature (e.g., above 1,000 degrees F.) in the presence of an oxidizing gas, the graphite will rapidly deteriorate ir disintegrate and will experience an extremely short service life. It is conventional, therefore, to protect the heating rods with a non-oxidizing gas such as nitrogen. Herein, nitrogen is admitted into each tube 17 to purge the tube of other gases and to prevent oxidation of the heating rods 33.

In accordance with the present invention, the pressure of the nitrogen in the tubes 17 is continuously monitored and is kept within a safe predetermined range so as to prevent leakage of outside atmosphere into the tubes and, at the same time, to keep the pressure in the tubes from rising to an excessively high level. Moreover, nitrogen is admitted into and exhausted from the tubes on an intermittent basis and only when necessary to keep the pressure within the safe range. Thus, the wasteful flow of nitrogen through the tubes is avoided.

Figure 5:
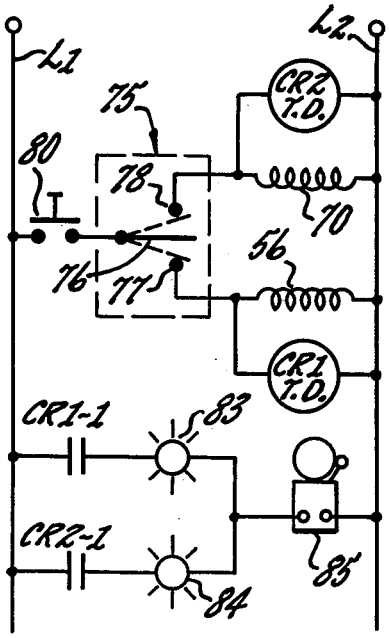
FIG. 5 is a diagram of an electrical circuit for controlling the flow of the protective gas.

More specifically, the nitrogan is supplied to the tubes 17 from a pressurized source such as a cylinder 53 (FIG. 6) via a pressure reducer 54 and a main control valve 55. The latter is controlled by a solenoid 56 and is adapted to be opened when the solenoid is energized, the solenoid being adapted for connection across a voltage source by way of lines L-1 and L-2 (FIG. 5).

A supply manifold 60 (FIG. 6) communicates with the valve 55 and includes branches 61 which lead to the various heating tubes 17. Each branch communicates with its respective tube by means of a gland 63 (FIG. 4) which extends through and is sealed to the cap 39 of the tube. While only two tubes have been shown in the drawings, it will be appreciated that the furnace 10 may include additional tubes which communicate with the manifold 60. The flow of gas to any given tube may be shut off by closing a manually operable valve 64 in the branch 61 for that tube.

Figure 6:
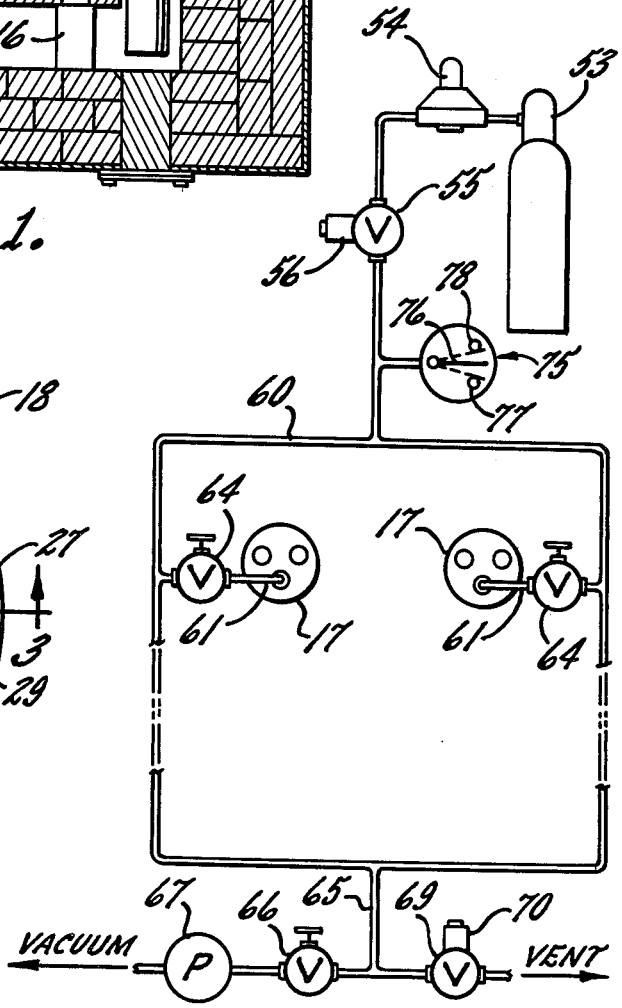
FIG. 6 is a diagram of the gas flow circuit.

As shown in FIG. 6, an exhaust line 65 leads from the manifold 60 and is connected to a manually operable exhaust valve 66 which communicates with a vacuum pump 67. The exhaust line also communicated with another valve 69 whose outlet is vented to the atmosphere. The valve 69 is controlled by a solenoid 70 and is opened upon energization of the solenoid. The solenoid 70 also is adapted to be connected across the lines L-1 and L-2 and forms a parallel combination with the solenoid 56.

In carrying out the invention, the pressure in the tubes 17 is monitored by a pressure-responsive switch 75 (FIGS. 5 and 6) which is adapted to detect the pressure in the manifold 60. The pressure switch is located immediately downstream of the inlet valve 55 and is shown schematically as including an arm 76 whose position varies in accordance with the pressure. The arm is connected in series with the parallel combination of the solenoids 56 and 70. If the pressure falls below a predetermined range, the arm swings against a switch contact 77 and connects the solenoid 56 across the lines L-1 and L-2. If the pressure rises above the range, the arm swings reversely against a contact 78 to energize the solenoid 70. As long as the pressure is within the range, the arm is located between the two contacts so that neither solenoid is energized. In this particular instance, the switch 75 is calibrated so that the arm 76 will close the contact 78 if the pressure should exceed atmospheric pressure by more than 25 inches water column and will close the contact 77 if the pressure drops below 3 inches water column above atmospheric.

Upon initial start up of the furnace 10, the valves 64 and 66 are opened and a manually operable switch 80 (FIG. 5) which is in series with the pressure switch 75 is opened to de-energize both solenoids 56 and 70 and cause the valves 55 and 69 to be closed. The vacuum pump 67 then is started so that the atmosphere in the tubes 17 may be quickly exhausted through the manifold 60, the exhaust line 65 and the valve 66. The pump 67 then is shut off and the valve 66 is manually closed but, just prior thereto, the manual switch 81 is closed to energize the solenoid 56 by way of the arm 76 and the contact 77 of the pressure switch 75. Thus, the inlet valve 55 is opened so that the tubes 17 are flushed with nitrogen. Purging of the tubes may be effected during the time required to bring the heatin pad 33 up to a temperature of 700 degrees F. since no significant oxidation of the graphite occurs below that temperature.

After the valve 66 has been closed, nitrogen continues to flow into the tubes 17 through the valve 55 until the pressure increases sufficiently to move the switch arm 76 away from the contact 77. As an incident thereto, the solenoid 56 is de-energized and closes the valve 55 to shut off the flow of nitrogen to the tubes.

When the valve 55 closes, the pressure of the nitrogen in the tubes 17 is just slightly above atmospheric pressure and hence the outside atmosphere is prevented from entering the tubes. With the heating rods 33 thus being protected against oxidation, the rods may be raised to a high temperature to heat the furnace chamber 14. As the temperature within the tubes increases, the pressure of the nitrogen also increases. If the pressure exceeds the upper limit as established by the pressure switch 75, the arm 76 of the switch closes the contact 78 to energize the solenoid 70 and open the exhaust valve 69. Nitrogen this is vented from the tubes 17 through the exhaust line 65 so as to relieve the pressure in the tubes and thereby prevent the tubes and/or the O-rings 40 and 46 from being damaged. Once the pressure drops below the upper limit, the switch arm 76 moves away from the contact 78 to effect closing of the exhaust valve 69 and thereby avoid needless venting of the nitrogen.

If nitrogen should leak from the tubes 17, the pressure ultimately will drop to a point where the switch arm 76 closes the contact 77. Under such circumstances, the inlet valve 55 again will be opened to admit additional nitrogen into the tubes and thereby prvent the outside atmosphere from entering the tubes and damaging the heating rods 33.

It is important to not that additional nitrogen is admitted into the tubes 17 only in such quantity as is necessary to replenish nitrogen which might leak from the upper ends of the tubes. Accordingly, the flow of nitrogen into the tubes is only on an intermittent basis rather than on a continuous basis and thus only a relatively small quantity of nitrogen is required to protect the heating rods 33.

Advantageously, means are provided for producing warning signals if the pressure in the tubes 17 remains at either the upper or lower limits beyond a predetermined period of time. Herein, these means comprise time delays CR1 and CR2 (FIG. 5), warning lights 83 and 84 and an alarm bell 85. The relays CR1 and CR2 are energized when the switch arm 76 closes the contacts 77 and 78, respectively. If the solenoid 56 is not de-energized to close the valve 55 within a predetermined time (e.g., 15 seconds) after the switch arm 76 first closes the contact 77 to open the valve, the relay CR1 times out and closes its contacts CR-1 to energize the warning light 83 and the alarm bell 85. The operator of the furnace 10 thus is alerted to the fact that more than an expected amount of time has elapsed without the nitrogen pressure being increased back to the safe range and that there may be excessive leakage in the system. If the relay CR2 remains energized beyond a predetermined time such as 15 seconds, it times out and closes its contacts CR2-1 to energize the warning light 84 and sound the alarm bell 85. The operator then is notified that the pressure in the tubes 17 has not been reduced and that the exhaust valve 69 or its solenoid 70 requires repair.

We claim:

1. A heating assembly comprising a closed tube, an electrical resistance heating element disposed in said tube, means for admitting a flow of protective gas into said tube and for exhausting a flow of said gas out of said tube, and means for sensing the pressure of the gas in said tube and for causing gas to be admitted into said tube when said pressure is below a predetermined range and to be exhausted out of said tube when said pressure is above said predetermined range.

2. A heating assembly as defined in claim 1 further including means for producing a warning signal if said pressure remains below said range beyond a predetermined time.

3. A heating assembly as defined in claim 1 further including means for producing a warning signal if said pressure remains above said range beyond a predetermined time.

4. A heating assembly as defined in claim 1 further including means for producing a first warning signal if said pressure remains below said range beyond a predetermined time, and means for producing a second and distinctive warning signal if said pressure remains above said range beyond a predetermined time.

5. A heating assembly comprising a closed tube, an electrical resistance heating element disposed in said tube, a source of protective gas, an inlet valve which is operable when opened to admit gas from said source into said tube and which is operable when closed to cut off the flow of gas from said source to said tube, an exhaust valve which is operable when opened to vent gas out of said tube and which is operable when closed to cut off the flow of gas out of said tube, and means for sensing the pressure in said tube and for causing said inlet valve to be opened and said exhaust valve to be closed when said pressure is below a predetermined range, for causing said inlet valve to be closed and said exhaust valve to be opened when said pressure is above said predetermined range and for causing both of said valves to be closed when said pressure is within said predetermined range.

* * * * *